US008448812B2

(12) United States Patent
Gruber et al.

(10) Patent No.: US 8,448,812 B2
(45) Date of Patent: May 28, 2013

(54) WASTE CONTAINER WITH BASE MEMBER

(75) Inventors: Robert V. Gruber, Dallas, TX (US); Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 1556 days.

(21) Appl. No.: 11/389,959

(22) Filed: Mar. 27, 2006

(65) Prior Publication Data

US 2006/0169706 A1 Aug. 3, 2006

Related U.S. Application Data

(62) Division of application No. 10/238,036, filed on Sep. 9, 2002, now Pat. No. 7,017,773.

(51) Int. Cl.
*B65D 25/24* (2006.01)

(52) U.S. Cl.
USPC ..... 220/630; 220/636

(58) Field of Classification Search
USPC ..... 220/630, 636, 628, 23.89, 626
See application file for complete search history.

(56) References Cited

U.S. PATENT DOCUMENTS

| | | | | |
|---|---|---|---|---|
| 2,907,491 | A | 10/1959 | Gunn | |
| 3,107,028 | A * | 10/1963 | De Robertis | 220/212 |
| D198,722 | S | 7/1964 | Cooper | |
| 3,272,466 | A | 9/1966 | Sherman | |
| 3,329,321 | A * | 7/1967 | Moore | 222/465.1 |
| 3,384,385 | A | 5/1968 | Cohen et al. | |
| 3,394,832 | A * | 7/1968 | McAllister et. al. | 220/254.3 |
| 3,547,299 | A | 12/1970 | Kepple | 220/4.01 |
| 3,830,514 | A | 8/1974 | Green | |
| 3,894,642 | A | 7/1975 | Shive | |
| 3,997,072 | A * | 12/1976 | Guth | 220/324 |
| 4,005,791 | A | 2/1977 | Stragier et al. | 414/408 |
| 4,167,271 | A * | 9/1979 | Jorgensen | 280/79.5 |
| 4,175,903 | A | 11/1979 | Carson | |
| 4,401,312 | A | 8/1983 | Parker | |
| 4,450,976 | A | 5/1984 | Snyder et al. | |
| 4,574,969 | A * | 3/1986 | Mays | 220/8 |

(Continued)

FOREIGN PATENT DOCUMENTS

| | | |
|---|---|---|
| CA | 2 344 843 A1 | 11/2001 |
| DE | 830171 | 1/1952 |

(Continued)

OTHER PUBLICATIONS

Brochure—Milko Der Milko 42-Liter-Rollerbehalter Minimale Abmessungen Maximaler Vorteil—2 pages—dated 1996.

*Primary Examiner* — Stephen Castellano
(74) *Attorney, Agent, or Firm* — Carlson, Gaskey & Olds

(57) ABSTRACT

A waste container provides at least one protrusion spaced below a lip extending radially outwardly from an upper edge of the waste container. The at least one protrusion is spaced below the lip to permit a gripper from an automatic lifter to grasp the waste container between the at least one protrusion and the upper lip. The at least one protrusion may be a plurality of triangular shaped bosses formed midway between the upper edge and lower edge of the waste container. Alternatively, the at least one protrusion may be a base portion which extends radially outwardly at a lower edge of the waste container. The at least one protrusion prevents the waste container from slipping completely through the grippers while the waste container is inverted while emptying the contents into a truck.

23 Claims, 5 Drawing Sheets

U.S. PATENT DOCUMENTS

| | | | | |
|---|---|---|---|---|
| 4,669,940 | A | 6/1987 | Englehardt et al. | |
| D291,738 | S | 9/1987 | Orlowski | |
| D291,739 | S | 9/1987 | Orlowski | |
| 4,749,101 | A | 6/1988 | Durkan, Jr. | |
| 4,765,503 | A | 8/1988 | Otto et al. | |
| 4,836,394 | A | 6/1989 | Glomski | |
| 4,992,018 | A | 2/1991 | Prout et al. | 414/408 |
| 5,088,750 | A | 2/1992 | Beese et al. | |
| 5,090,585 | A | 2/1992 | Power | 220/495.04 |
| D347,095 | S | 5/1994 | Apps et al. | |
| D388,577 | S | 12/1997 | Rehrig et al. | |
| 5,758,888 | A | 6/1998 | Burgan et al. | |
| 5,762,230 | A | 6/1998 | Policappelli | 220/62.12 |
| D398,120 | S | 9/1998 | Rehrig et al. | |
| 5,862,932 | A | 1/1999 | Walsh et al. | |
| D410,125 | S | 5/1999 | Rehrig et al. | |
| 5,899,468 | A | 5/1999 | Apps et al. | |

FOREIGN PATENT DOCUMENTS

| | | | |
|---|---|---|---|
| DE | 1191740 | | 4/1965 |
| DE | 2156013 | | 5/1973 |
| DE | 3436566 | A1 | 4/1986 |
| DE | 3636019 | A1 | 4/1988 |
| EP | 138-780 | A2 | 4/1985 |
| EP | 288-066 | A2 | 10/1988 |
| EP | 0 392 684 | A | 10/1990 |
| EP | 1 106 535 | A1 | 6/2001 |
| WO | WO 97/46468 | A1 | 12/1997 |
| WO | WO 03/050017 | A1 | 6/2003 |

* cited by examiner

WASTE CONTAINER WITH BASE MEMBER

REFERENCE TO RELATED APPLICATION

This application is a divisional patent application of U.S. patent application Ser. No. 10/238,036 filed Sep. 9, 2002, now U.S. Pat. No. 7,017,773.

BACKGROUND OF THE INVENTION

The present invention relates generally to containers and more particularly to a waste container for use with automated handling equipment.

Some residential waste collection services have an automatic lifter for lifting and dumping the waste containers into the waste truck. Generally, the lifter includes grippers which grasp the waste container. The lifter then lifts the waste container from the ground and inverts the waste container to dump the contents into the waste truck. The lifter then rotates the waste container back to an upright position and returns the waste container to its original position on the ground.

The waste container includes a lip at an upper end of the waste container which protrudes radially outward from an upper edge of the wall of the waste container. The lip prevents the waste container from slipping through the grippers when the lifter lifts the waste container up off the ground. However, while inverted, the waste container may slip through the grippers and become damaged.

Some containers have wheels on their bottom for rolling the container. The wheels also serve as stop mechanisms that stop the container from slipping through the grippers when inverted. Some containers, particularly large containers used by municipalities, are often large, rectangular containers having contoured, tapered bodies and beveled surfaces that prevent slippage. Unfortunately, traditionally-shaped containers without the contours, tapers or bevels and without wheels are still subject to slippage through the grippers.

SUMMARY OF THE INVENTION

The present invention provides a waste container including at least one protrusion extending outward from the container and spaced below the lip. The grippers grip the waste container between the lip and at least one protrusion. If the waste container starts to slip while inverted, the protrusions will catch the grippers, thereby preventing the waste container from falling.

In one embodiment, at least one protrusion comprises a plurality of bosses integrally molded in the body wall of the waste container. The bosses may comprise inverted triangles arranged in pairs around the circumference of the waste container.

In a second embodiment, the at least one protrusion comprises a base portion at a lower edge of the waste container, the waste portion extending radially outward from the waste container. The base portion may be snap-fit to a lower edge of the waste container or integrally molded with the rest of the container.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENTS

Figure 1:
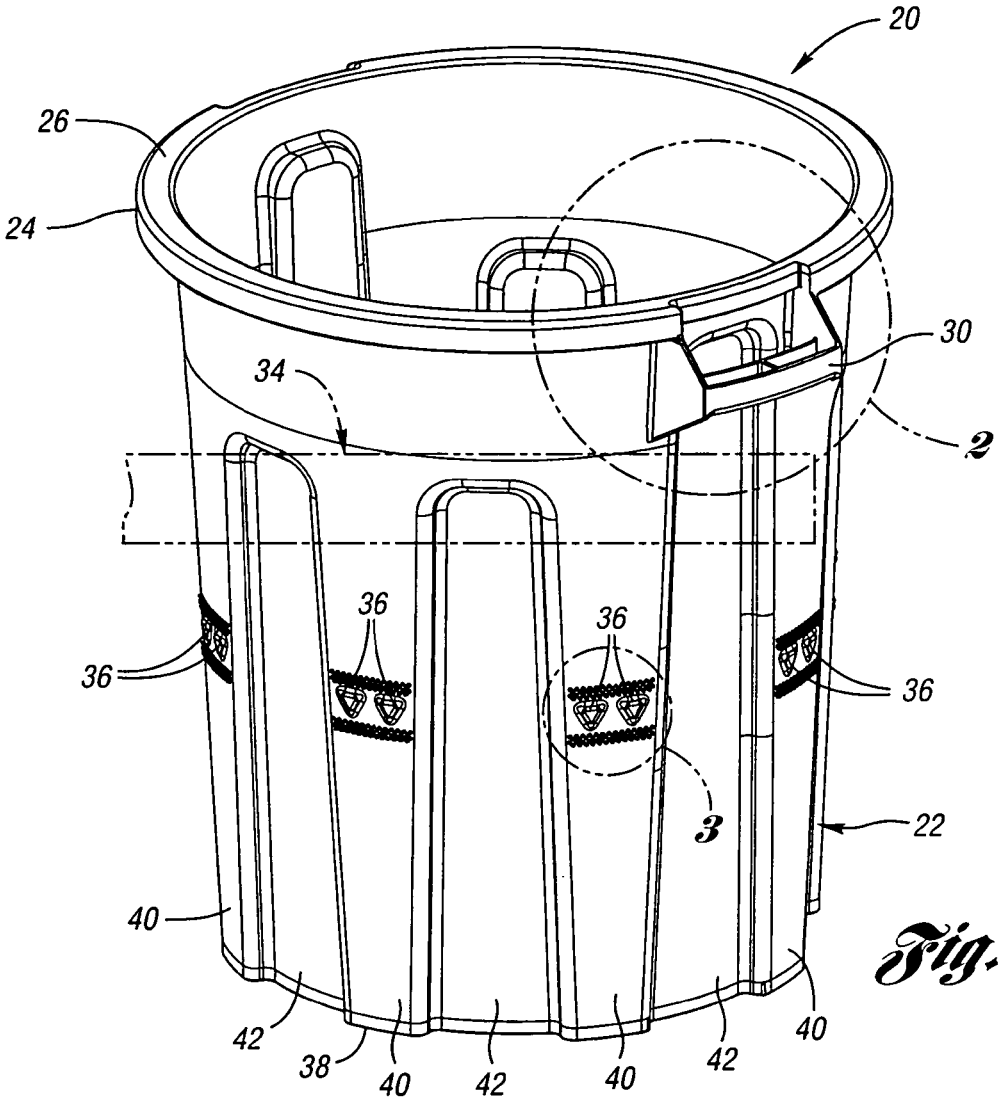
FIG. 1 illustrates a waste container of the present invention according to a first embodiment.

FIG. 1 illustrates a waste container 20 according to a first embodiment of the present invention. The waste container 20 includes a generally cylindrical body wall 22 having a lip 24 protruding radially outward about the circumference of an upper edge 26 of the body wall 22. The waste container 20 further includes a pair of handles 30 (one shown) which also protrude radially outward from the body wall 22. The lip 24 and handles 30 are designed to be engaged by grippers 34 (one shown in phantom) of an automatic lifter on the waste collection truck. If the waste container 20 begins to slip through the grippers 34 while being lifted, the grippers 34 engage the lip 24 and/or handles 30, thereby preventing the waste container 20 from slipping completely through the grippers 34.

The present invention also provides a plurality of protrusions 36 formed below the area of engagement by the grippers 34. As shown in FIG. 1, the plurality of protrusions 36 are formed in the body wall 22, approximately midway between the upper edge 26 and a lower edge 38. The protrusions 36 are generally bosses molded in the body wall 22. For example, the protrusions 36 may be inverted triangular bosses arranged in pairs about the circumference about the waste container 20. As shown in FIG. 1, the body wall 22 may comprise a plurality of splines, including outer splines 40 and alternating inner splines 42. The protrusions 36 are formed on the outer splines 40.

Figure 2:
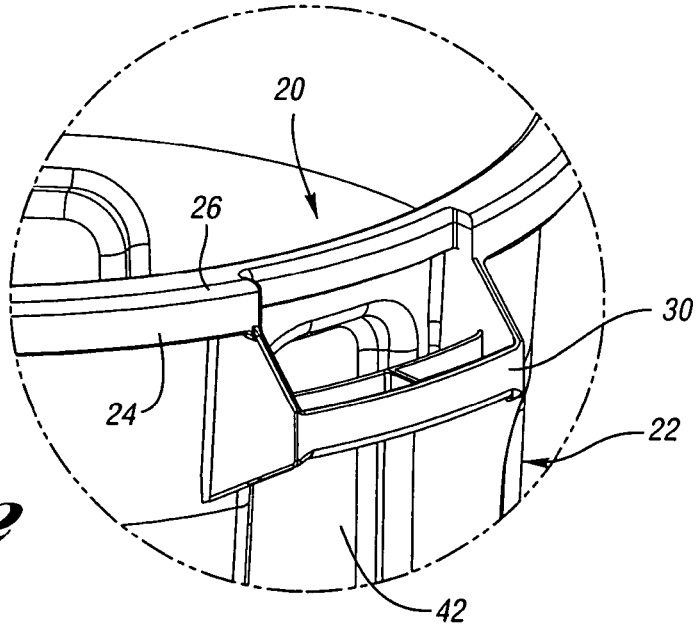
FIG. 2 is an enlarged view of the handle and upper end of the waste container of FIG. 1.

FIG. 2 is an enlarged view of the handle 30 of the waste container 20. Each handle 30 is formed adjacent the upper edge 26 and lip 24 and is positioned over one of the inner splines 42.

Figure 3:
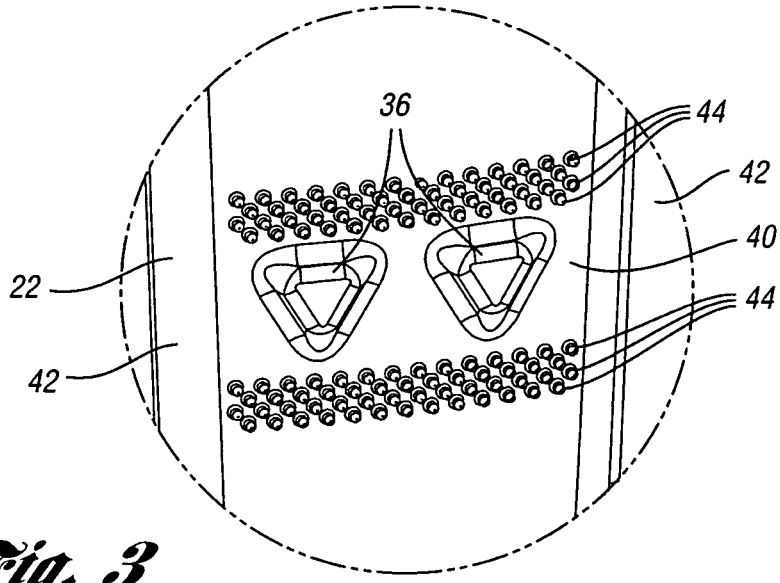
FIG. 3 is an enlarged view of the bosses in FIG. 1.

FIG. 3 is an enlarged view of two of the protrusions 36 of the waste container 20 of FIG. 1. As can be seen in FIG. 3, the protrusions 36 comprise inverted triangular bosses, arranged side-by-side in pairs spaced circumferentially around the body wall 22 on the outer splines 40. The upper side of the triangle of the triangular bosses 36 is arranged to engage a gripper 34 (FIG. 1) when the waste container 20 is inverted, thereby preventing the waste container 20 from slipping through the grippers 34. As shown in FIG. 3, a stripe of smaller bosses 44 is arranged above and below the pair of triangular bosses 36 to further increase the friction between the gripper 34 (FIG. 1) and the waste container 20 when inverted.

Figure 4:
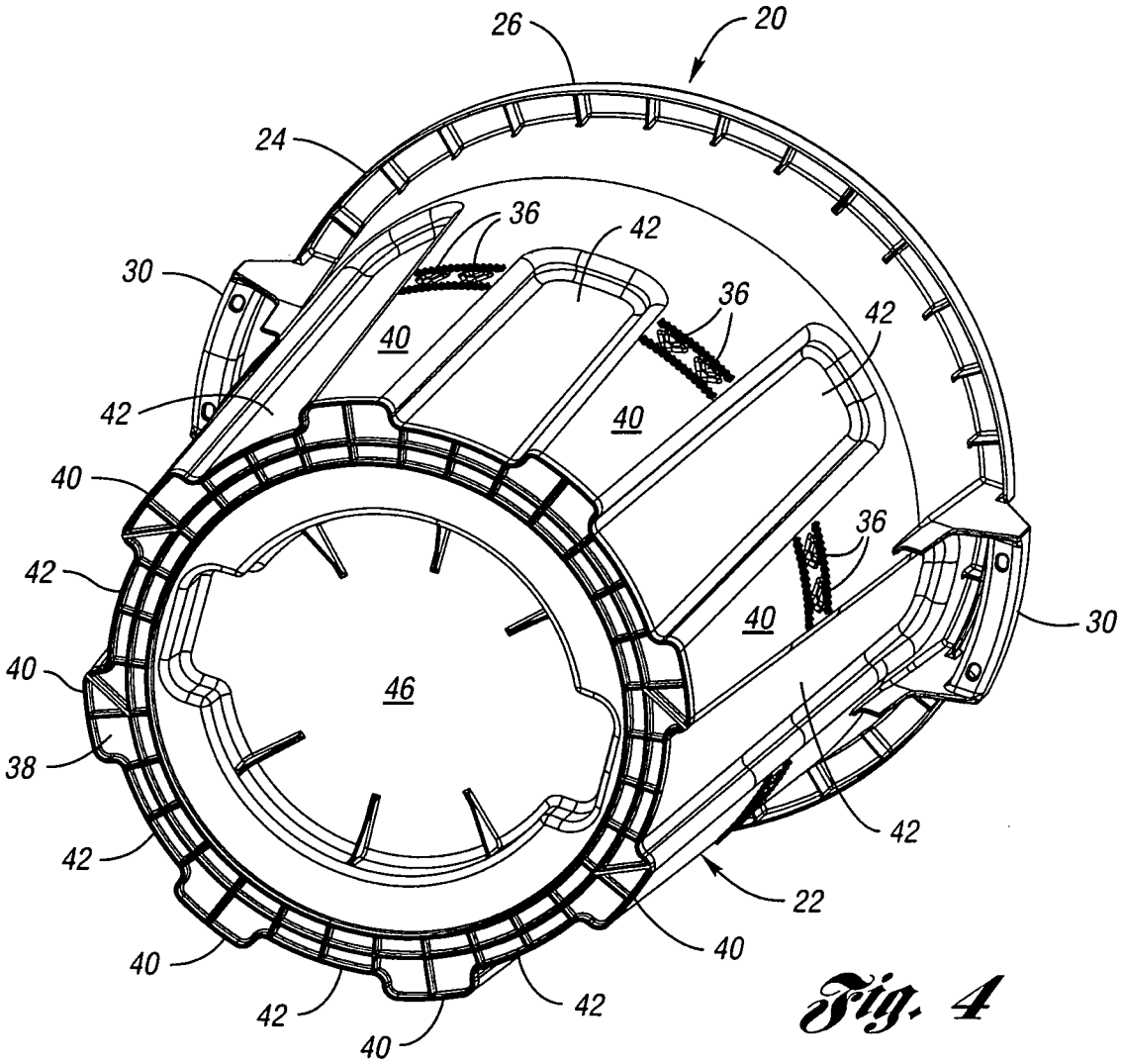
FIG. 4 is a perspective view of the bottom of the waste container of FIG. 1.

FIG. 4 is a bottom perspective view of the waste container 20 of the present invention. As can be seen in FIG. 4, the alternating inner and outer splines 42, 40 are integrally molded with a bottom wall 46 at the lower edge 38. As can also be seen in FIG. 4, the handles 30 are arranged at diametrically opposed sides of the body wall 22.

Figure 5:
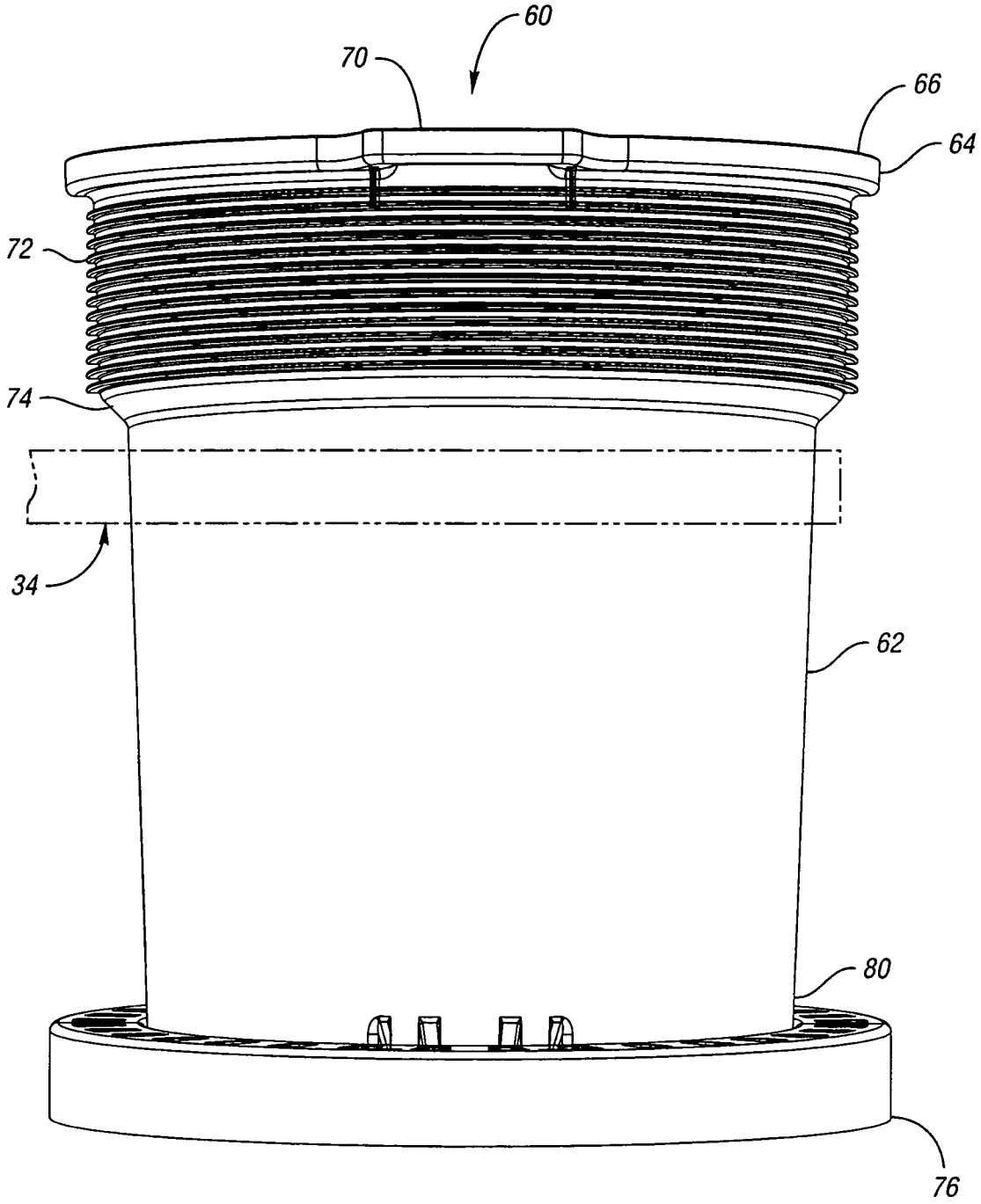
FIG. 5 is a second embodiment of a waste container according to the present invention.

FIG. 5 illustrates a waste container 60 according to a second embodiment of the present invention. The waste container 60 comprises a generally cylindrical body wall 62 having a lip 64 protruding radially outward from an upper edge 66 of the body wall 62. The waste container 60 further includes a pair of handles 70 (one shown) protruding radially outward from the upper edge 66 of the body wall 62. The body wall 62 further includes a portion 72 of increased diameter, thereby providing a circumferential ridge 74. The circumferential ridge 74, lip 64 and/or handle 70 may all engage the grippers 34 when the automatic lifter (not shown) lifts the waste container 60.

A base portion 76 protrudes radially outwardly about the circumference of the body wall 62 at a lower edge 80 of the body wall 62. The base portion 76 may be integrally molded with the body wall 62 or, as will be described below, may be snap-fit or otherwise removably or non-removably secured to the lower edge 80 of the body wall 62. In the second embodiment, if the waste container 60 begins to slip through the grippers 34 when the waste container 60 is inverted, the grippers 34 will engage the base portion 76, thereby preventing the waste container 60 from slipping completely through the grippers 34.

Figure 6:
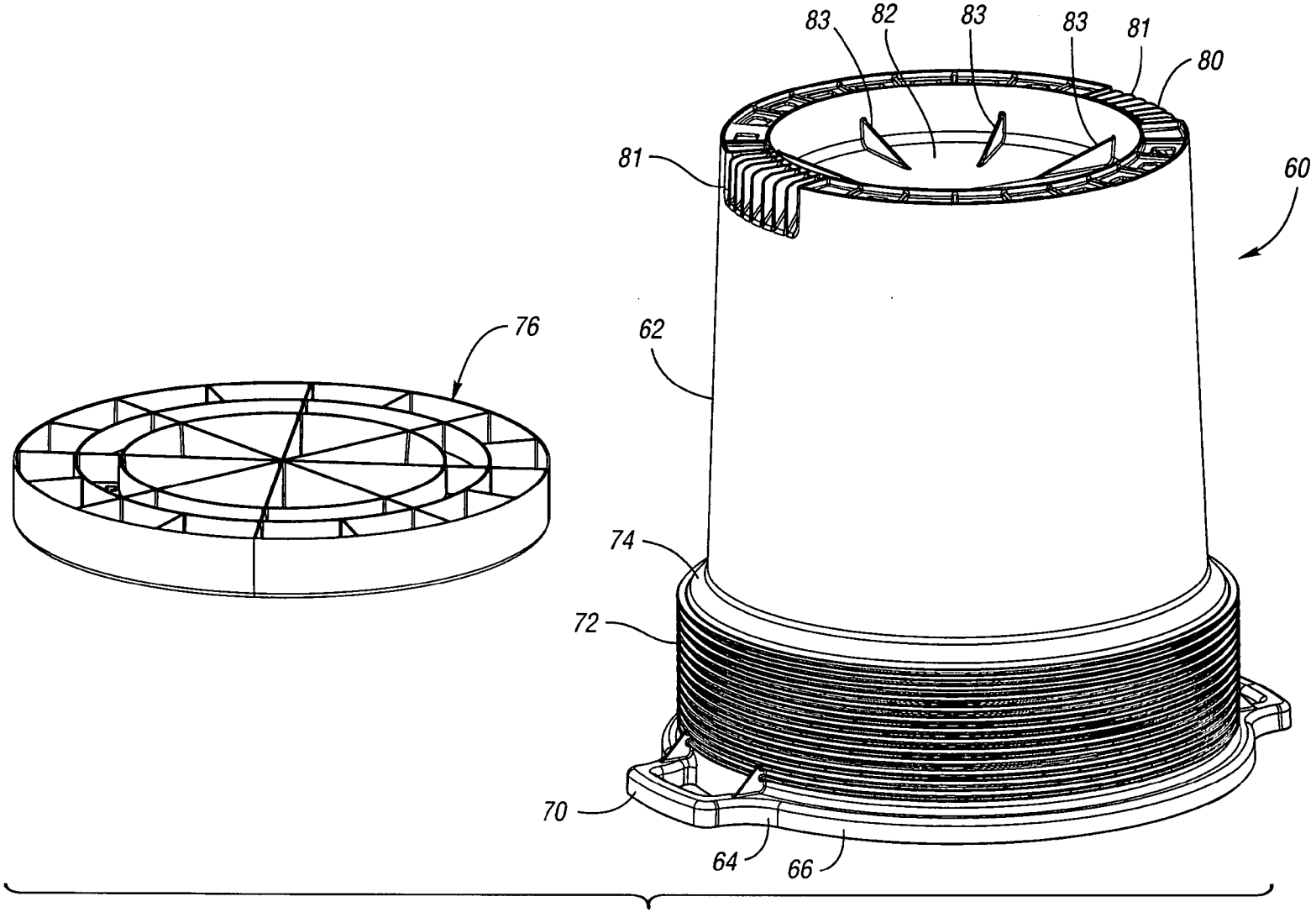
FIG. 6 is a disassembled bottom perspective view of the waste container of FIG. 5.
Figure 7:
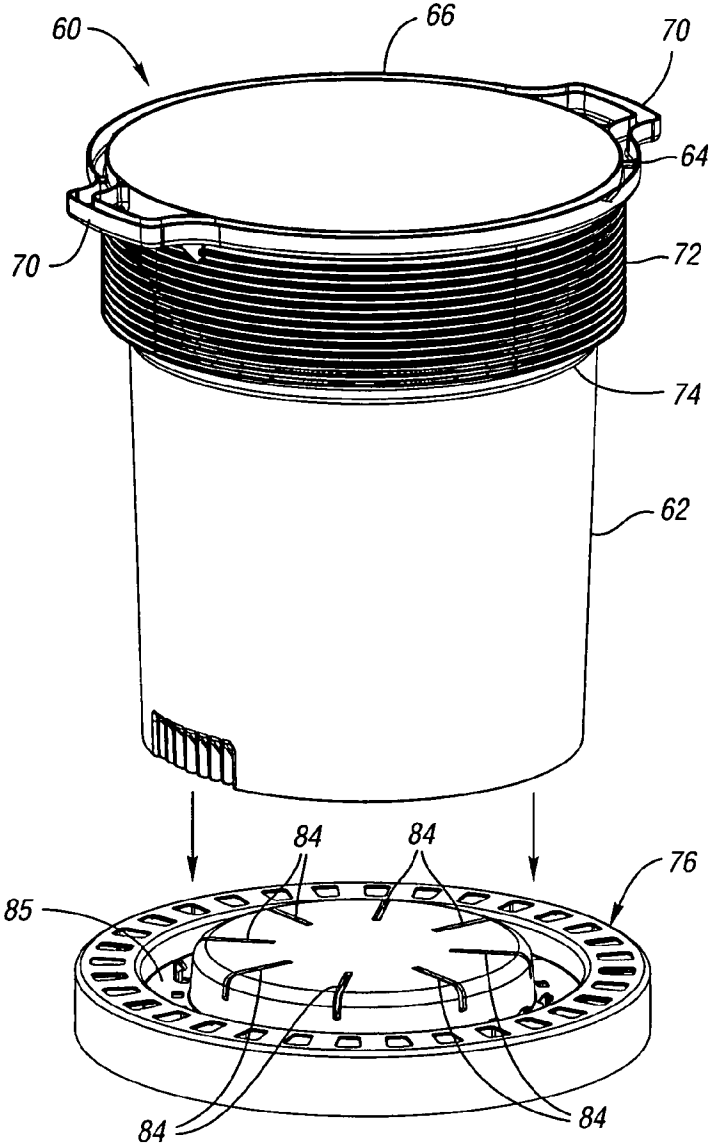
FIG. 7 is an exploded view showing assembly of the waste container of FIG. 5.

FIG. 6 is a disassembled bottom perspective view of the waste container 60 of FIG. 5. As can be seen in FIG. 6, the waste container 60 includes drag ribs 81 formed at the lower edge 80 of the waste container 60 adjacent a bottom wall 82, which is recessed from the lower edge 80 of the waste container 60. Circumferentially-spaced, radial fins 83 extend downward from the bottom wall 82, for engagement with complementary slots 84 in the base portion 76, which are shown in FIG. 7. FIG. 7 shows the assembly of the waste container 60. As can be seen in FIG. 7, the base portion 76 includes an annular recess 85 on a top surface. The lower edge 80 of the waste container 60 is received within the annular recess 85 of the base portion 76. The base portion 76 may be permanently or removably secured to the lower edge 80 of the waste container 60, or may be snap-fit together as described below.

Figure 8:
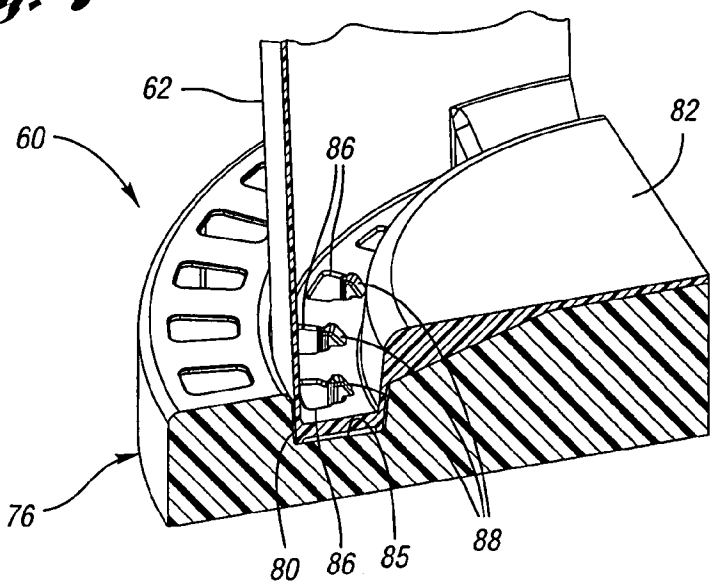
FIG. 8 is a sectional view of the waste container of FIG. 5, showing the connection of the base to the rest of the container.

FIG. 8 is an enlarged sectioned view of the lower edge 80 of the waste container 60 connected to the base portion 76. As can be seen in FIG. 8, the lower edge 80 of the body wall 62 is received in the annular recess 85. The lower edge 80 of the body wall 62 includes a plurality of apertures 86 which are snap-fit with a plurality of locking tabs 88 protruding upward from the annular recess 85 of the base portion 76. In this manner, the body wall 62 is secured to the base portion 76.

In use, the waste containers 20, 60 will be lifted by grippers 34. In case of slippage, the grippers 34 may engage one or more of the radial protrusions from the upper end 26, 66 of the waste container 20, 60, such as the upper lip 24, 64 or the handles 30, 70, or the annular ridge 74. The waste container 20, 60 is then inverted by the grippers 34 to empty the contents, at which time the grippers 34 may begin to slip along the body wall 22, 62 of the container 20, 60. In the present invention, the grippers 34 will catch on the protrusions 36, 76, thus preventing the waste container 20, 60 from falling into the truck or onto the ground, and thus preventing damage to the waste container 20, 60. Thus, the present invention may provide resistance to slippage for traditionally-shaped containers without contours, tapers or bevels and without wheels.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Although two preferred embodiments of the present invention have been illustrated and described, it should be recognized that many variations on these designs would also be within the scope of the present invention. For example, although pairs of inverted triangular bosses 36 are preferred, other shaped bosses or other protrusions molded into the body wall 22 would also be within the scope of the present invention. Further, although the bosses 36 are arranged in pairs circumferentially around the waste container 20, other arrangements or numbers of bosses or other molded protrusions would also be within the scope of the present invention. Further, as explained above, although base portion 76 is illustrated and described as a snap-fit assembly onto the body wall 62, the base portion could also be integrally molded, heat welded, or secured by fasteners or adhesive or any other means and still be within the scope of the present invention.

What is claimed is:

1. A waste container comprising a body wall;

a bottom wall closing a lower end of the body wall, wherein the body wall is integrally molded with the bottom wall to define a single component, and an outer circumference of the bottom wall includes an annular recess, and the body wall and the bottom wall define an interior space of the waste container;

a lip extending radially outward from an upper end of the body wall; and a base member extending radially outward from the lower end of the body wall, wherein the base member includes a top surface having an annular recess, and the lower end of the body wall is received in the annular recess of the base member.

2. The waste container of claim 1 wherein the base member is removably secured to the lower end of the body wall.

3. The waste container of claim 2 wherein the base member is removably secured to the bottom wall.

4. The waste container of claim 3 wherein the base member is snap-fit to the bottom wall.

5. The waste container of claim 1 wherein the base member is generally disk-shaped.

6. The waste container of claim 1 wherein the base member is integrally molded with the body wall.

7. The waste container of claim 1 wherein the lower end of the body wall includes ribs.

8. The waste container of claim 1 wherein the bottom wall includes fins and the base member includes slots, and the fins engage the slots.

9. The waste container of claim 1, wherein the bottom wall includes a plurality of apertures and the annular recess of the top surface includes a plurality of locking tabs, wherein the plurality of apertures are snap-fitted with the plurality of locking tabs.

10. The waste container of claim 1, wherein the body wall is generally cylindrical.

11. The waste container of claim 1, wherein the body wall includes a portion of increased diameter that provides a circumferential ridge.

12. The waste container of claim 1, wherein a gripping area is defined between the lip and the base member for engagement by a gripper for lifting and inverting the waste container.

13. The waste container of claim 1, wherein the body wall is non-collapsable.

14. The waste container of claim 1 wherein the lower end of the body wall includes ribs, the bottom wall includes fins and a plurality of apertures, and the base member includes slots and the top surface having the annular recess, the annular recess including a plurality of locking tabs, wherein the fins engage the slots, the lower end of the body wall is received in the annular recess of the base member, and the plurality of apertures are snap-fitted with the plurality of locking tabs.

15. The waste container of claim 1 wherein the base member contacts the body wall.

16. The waste container of claim 1 wherein the annular recess of the bottom wall is received in the annular recess of the base member.

17. The waste container of claim 1 wherein the annular recess of the bottom wall has a width.

18. The waste container of claim 1 wherein the outer circumference of the bottom wall is connected to the lower end of the body wall.

19. The waste container of claim 1 wherein a portion of the annular recess of the bottom wall is substantially perpendicular to the body wall.

20. The waste container of claim 19 wherein another portion of the annular recess of the bottom wall is substantially parallel to the body wall.

21. The waste container of claim 1 wherein the bottom wall includes an inner portion and an outer portion that defines the annular recess, and the inner portion is raised with respect to the outer portion.

22. The waste container of claim 1 wherein the body wall and the bottom wall are integrated into the single component.

23. The waste container of claim 1 wherein the body wall and the bottom wall are integrally molded in a single molding operation.

* * * * *